US005423087A

United States Patent [19]

Krent et al.

[11] Patent Number: 5,423,087

[45] Date of Patent: * Jun. 13, 1995

[54] BODY PROTECTIVE DEVICE

[76] Inventors: Edward D. Krent, 207 Hampton Rd., Sharon, Mass. 02067; Nicholas B. Paffett, 806 Tucker La., Hingham, Mass. 02043

[ * ] Notice: The portion of the term of this patent subsequent to Dec. 8, 2009 has been disclaimed.

[21] Appl. No.: 39,108

[22] PCT Filed: Oct. 2, 1991

[86] PCT No.: PCT/US91/07374

§ 371 Date: Apr. 1, 1993

§ 102(e) Date: Apr. 1, 1993

[87] PCT Pub. No.: WO92/05717

PCT Pub. Date: Apr. 16, 1992

[51] Int. Cl.[6] ..... A41D 13/00

[52] U.S. Cl. ..... 2/2; 2/267

[58] Field of Search ..... 2/2, 16, 22, 24, 267, 2/268, 243 R, 243 A, DIG. 1, 44, 45; 128/89 R, 156, 157; 264/108, 239, 241

[56] References Cited

U.S. PATENT DOCUMENTS

| | | | |
|---|---|---|---|
| 1,970,130 | 8/1934 | Dickenson | 2/2 |
| 2,440,664 | 4/1948 | Freedman | 2/42 |
| 2,553,612 | 5/1951 | Taylor | 2/22 |
| 2,976,539 | 3/1961 | Brown. Jr. | 2/2 |
| 3,125,762 | 3/1964 | Glahe | 2/2 |
| 3,208,080 | 9/1965 | Hirsch | 2/3 |
| 3,248,738 | 5/1966 | Morgan | 2/2 |
| 3,348,236 | 10/1967 | Copeland | 2/2 |
| 3,945,042 | 3/1976 | Lobo | 2/2 |
| 4,272,847 | 6/1981 | Buhler | 2/2 |
| 4,292,263 | 9/1981 | Hanrahan et al. | 2/23 |
| 4,307,471 | 12/1981 | Lovel | 2/411 |
| 4,325,148 | 4/1982 | Livernois | 2/2 |
| 4,422,183 | 12/1983 | Landi et al. | 2/2 |
| 4,453,271 | 6/1984 | Donzis | 2/2 |
| 4,507,801 | 4/1985 | Kavangh et al. | 2/2 |
| 4,538,301 | 9/1985 | Sawatski et al. | 2/2 |
| 4,580,408 | 4/1986 | Stueber | 2/DIG. 1 |
| 4,642,814 | 2/1987 | Godfrey | 2/413 |
| 4,677,698 | 7/1987 | Angas | 2/DIG. 16 |
| 4,680,813 | 7/1987 | Glaeser | 2/DIG. 1 |
| 4,685,155 | 8/1987 | Fingerhut et al. | 2/DIG. 1 |
| 4,688,269 | 8/1987 | Maeshima | 2/2 |
| 4,700,407 | 10/1987 | Mattila | 2/2 |
| 4,788,972 | 12/1988 | DeBusk | 2/243 |
| 4,810,559 | 3/1989 | Fortier et al. | 2/2 |
| 4,825,476 | 5/1989 | Andrews | 2/421 |
| 4,884,295 | 12/1989 | Cox | 2/2 |
| 4,926,503 | 5/1990 | Wingo | 2/2 |
| 4,982,447 | 1/1991 | Henson | 2/2 |
| 5,007,108 | 4/1991 | Loberge et al. | 2/2 |
| 5,146,621 | 9/1992 | Hadar et al. | 2/2 |
| 5,274,846 | 1/1994 | Kolsky | 2/2 |

FOREIGN PATENT DOCUMENTS 3401111 7/1985 Germany .

*Primary Examiner*—Clifford D. Crowder
*Assistant Examiner*—Amy B. Vanatta
*Attorney, Agent, or Firm*—Wolf, Greenfield & Sacks

[57] ABSTRACT

Protective body padding comprising a plurality of foam modules interconnected by a membrane. The foam modules and/or membrane have a plurality of perforations extending completely therethrough and a matrix of interconnecting air channels designed to provide breathability and cooling capacity to allow venting of heat and moisture from the skin. In a preferred embodiment, the foam in the modules is of a variable flexibility, wherein the flexibility of foam closest to the skin is greater than the flexibility of foam immediately above. For sports use, the modules can be positioned between the upper and lower resilient layers in a variety of positions to articulate with vulnerable body parts. Moreover, the foam can be colored or provided with an array of tradenames, trademarks and/or logos to enhance the aesthetic and fashion qualities thereof. In an alternative embodiment, the modules may be formed of an insert captured between two layers of flexible material, the insert having fins formed thereon to allow proper centering of the insert during assembly. For high impact sports, a hardened shell is provided on each module, and reinforcing means are provided surrounding the openings of the air passages on the upper surface of the shell.

18 Claims, 18 Drawing Sheets

BODY PROTECTIVE DEVICE

FIELD OF THE INVENTION

This invention relates generally to the field of protective body padding and, more specifically, to articulated, breathable, modular padding with a stretchable membrane.

BACKGROUND OF THE INVENTION

For the past several decades, the popularity of outdoor sports has increased participation in activities that require protective body padding. Especially among 5–15 year olds, sports activities such as on-road and off-road biking, roller blading, roller skating, skateboarding, boogie boarding, surfing, and windsurfing, and the injuries attendant thereto, have revealed that these sports do indeed involve falls and collisions and that a variety of serious injuries including bumps and abrasions can result from such accidents. Furthermore, more conventional sports such as baseball, basketball, football, hockey, soccer and the like also require body protective devices.

Nevertheless, many existing body protection devices cannot be articulated in response to movement of body joints to reflect the patterns of motion of the various sports. Moreover, conventional protective body devices do not permit the escape of heat or moisture from the skin. As a result, the wearer becomes uncomfortably warm, and the padding in the devices becomes saturated with sweat. This becomes especially important when it is appreciated that over 40% of the body is covered by protective padding during contact sports such as football.

In addition, many young people will not wear conventional body protective devices because such padding is not fashionable, is unattractive or is uncomfortable.

SUMMARY OF THE INVENTION

It is an object of this invention to provide a body protection device that permits the escape of heat and moisture from the skin.

It is a further object of this invention to provide articulated body padding that can be adapted to protect a wide variety of vulnerable body parts.

It is another further object of the invention to provide articulated body padding that is fashionable and that can be easily made in different colors and shapes as well as easily adapted to receive various logos, trademarks, tradenames and decorations.

In accordance with the foregoing objects, the present invention is related to body padding comprising a plurality of articulated breathable molded foam modules. Specifically, the modules of the body padding of this invention include impact resistant foam having an upper surface and a lower surface embedded between an upper and lower layer of resilient, breathable fabric. The padding modules are connected to each other through thinner stretchable areas called intermodular membranes that are not necessarily designed for impact absorption but which permit articulation and which may allow heat and moisture to escape from the skin.

In a preferred embodiment, each module or the membranes or both the modules and membrane have a plurality of air passages extending completely through from the upper surface to the lower surface. The lower entrance of each of the passages communicates with a recessed air chamber. In preferred embodiments, additional air channels connect adjacent recessed air chambers so that, when the body padding is worn, heat, moisture, salt, gases, and the like released from the skin are removed by the circulation of air through the air channels and out through the air passages.

The lower breathable fabric layer may be a cotton-lycra stretch material and the upper breathable fabric layer may be a durable bonded stretch fabric such as nylon. Preferably, the intermodular membranes comprise a layer of closed or open cell neoprene that is sandwiched between the lower layer of cotton-lycra and the upper layer of durable bonded stretch fabric.

In a preferred embodiment of the invention, the foam that mares up the padding modules is formed of a plurality of layers, such as three. The top layer typically is the most rigid of the three layers, the middle layer is less rigid and has high shock absorption properties, and the layer closest to the skin is the most flexible of the three layers. The most flexible layer is immediately adjacent to the cotton lycra stretch fabric layer, and cushions and conforms to the body. The middle layer helps absorb impacts. The most rigid layer is designed to distribute point impacts to a larger area and to protect the layers below from impact damage.

In another embodiment, the modules are connected by tapered sections and these tapered, thinner sections have a plurality of air passages extending completely therethrough. The lower entrance of each of the passages communicates with air channels which connect adjacent air passages and which space the padding from the skin, thus promoting ventilation of the skin.

In yet another embodiment of the invention, high density plastic or resin is applied to the upper layer of bonded stretch fabric at strategic locations to provide a hard surface for wear resistance or for enhancing the ability of the pads to slide over and not grip a playing surface, while still maintaining the breathability and flexibility of the fabric and pads. These high density plastic or resin locations may be provided with a light reflecting material for increased nighttime visibility. Plastic can be applied in various patterns for both graphic and protective effect. In further embodiments of the invention, the upper fabric layer of durable bonded stretch material can be an open-weave nylon or a mesh covering.

In one embodiment, the membrane is secured to each of the modules. In another embodiment, the upper and lower fabric surfaces of the membrane form upper and lower surfaces of the modules, so that the body padding comprises one continuous web with no interruptions between the membrane and the modules. In another further embodiment, the membrane forms either the upper or the lower surface of the module, and another opposed fabric layer is secured to the membrane around the periphery of the module to capture the module between this fabric layer and the membrane.

In another aspect of the invention, the modules comprise previously formed inserts which are captured between two fabric layers, or between the membrane and another opposed, fabric layer. In one embodiment of this feature of the invention, the modules contain a layer of air pockets which are captured between layers of foam.

In another embodiment of this feature of the invention, a method of preparing a module is disclosed in which inserts are positioned between fabric layers, or between two foam layers which are then covered by fabric. The fabric layers are then drawn tightly around the inserts, or the inserts and the foam layers, and the fabric layers are sealed together around the periphery of the insert. To make certain that the insert is properly centered in the module, fins are provided around the perimeter of the insert to prevent the insert from moving with respect to the fabric layers during the assembly process.

In another further aspect of the invention, where a high density plastic or resin shell is disposed on the upper surface of a module, added strength can be provided to the shell by dimples or depressions around the openings for the air passages, or by ridges disposed between the openings for the air passages.

The protective body armor of this invention can be adapted to fit many body parts including knees, ankles, wrists, hands, elbows, head, shoulders, chest, back and shins.

DETAILED DESCRIPTION OF THE DRAWINGS

The objects, advantages and features of the invention will be more clearly appreciated from the following detailed description of the invention when taken in conjunction with the drawings in which:

FIG. 1 is a cross-sectional view of padding employing the present invention;

FIG. 2 ms a top plan view of a padding module of this invention;

DETAILED DESCRIPTION OF THE INVENTION

Figure 1:
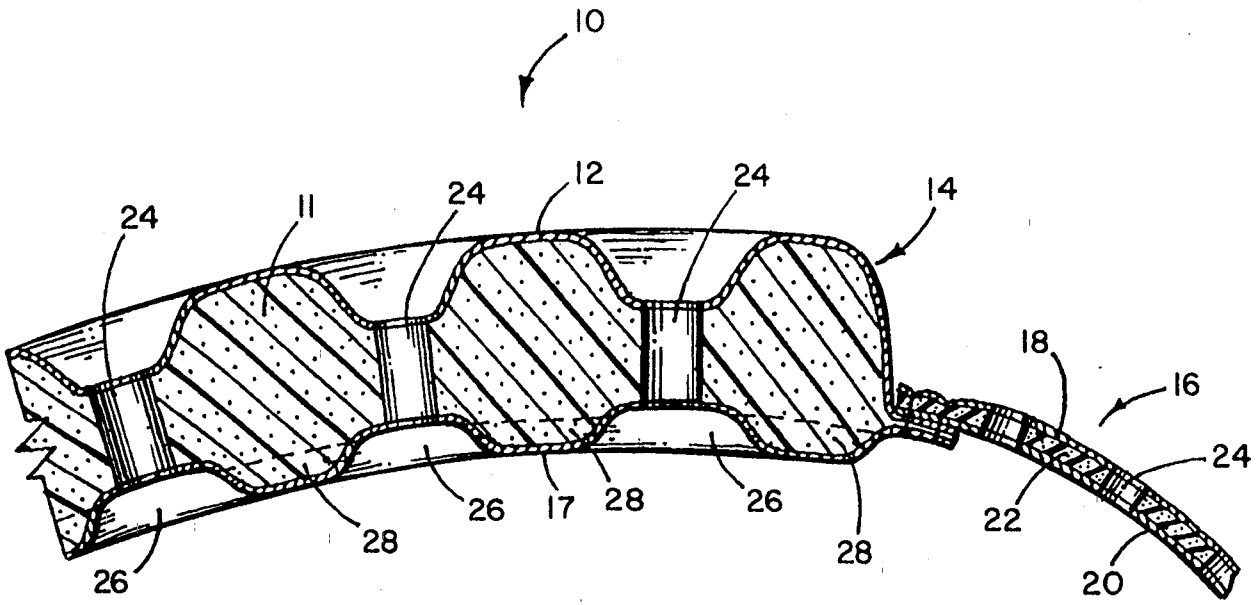

With reference now to the drawings, and more particularly to FIG. 1 thereof, the body padding of this invention will be described. Body padding 10 broadly includes a plurality of thicker, padded sections, referred to as modules 14, which are interconnected by thinner portions which are referred to as intermodular membranes 16. Modules are designed to protect the body by absorbing blows thereto and to protect the skin from abrasions. Intermodular membranes 16 are intended to resist abrasions, and to interconnect modules 14 so as to permit articulation of padding 10 in response no body movement. Typically, an extension of membrane 16 tightly surrounds a portion of the body to elastically retain padding 10 in place on the body portion, although padding 10 may be retained in a desired location on the body by other known means.

Each module 14 is formed of an interior material 11 sandwiched between an upper layer 12 and a lower layer 17. Material 11 typically is a molded foam, while layers 12 and 17 typically are formed of a resilient or elastic material. Intermodular membrane 16 comprises an upper layer 18 and a lower layer 20 having a layer 22 sandwiched therebetween. Layers 18 and 20 may be formed of the same material as layers 12 and 17 and may comprise any flexible or elastic material. Layer 22 typically is flexible, and can stretch along with layers 18 and 20 to allow padding 10 to be placed in position on the body or removed therefrom. Layers 17 and 20 typically are placed adjacent the skin when padding 10 is in use.

Both modules 14 and membranes 16 are traversed by a plurality of air passages 24 which provide gaseous communication between an upper surface adjacent layers 12 and 18, and a lower surface adjacent layers 17 and 20. Air passages 24 permit the escape of moisture, heat, salt, gases and the like from the skin's surface to the external environment. Air passages 24 may be die cut into the foam material 11 prior to assembly, or after assembly.

Figure 3:
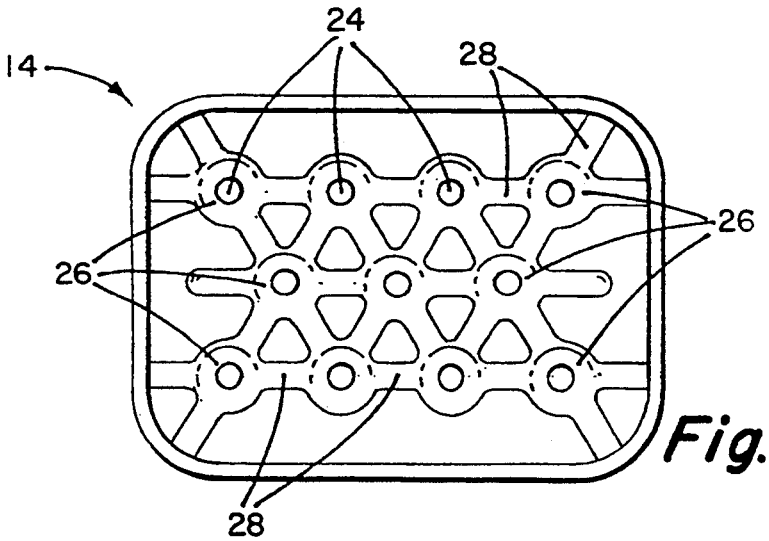
FIG. 3 is a bottom plan view of the padding module 14 of FIG. 2.

In a preferred embodiment, the lower surface of each module 14 is provided with a plurality of channels interconnecting air passages 24 to allow more complete ventilation and cooling of the skin. One acceptable configuration of this feature is shown in FIG. 3. Each air passage 24 opens into a recessed chamber 26 in the lower surface of module 14 facing the skin. Each chamber 26 is placed in communication with at least one other chamber 26 of an adjacent air passage 24 by means of a channel 28. Typically, a plurality of channels 28 interconnect each chamber 26 with a number of adjacent chambers 26 of associated air passages 24. In this manner, as module 14 is placed adjacent the skin, channels 28 and chambers 26 cooperate to provide gaseous communication between air passages 24 and large portions of the skin surface to allow heat and perspiration to be vented from the skin through air passages 24. In an alternative embodiment, channels 28 may be formed as parallel, closely spaced undulations in the undersurface of module 14 and may extend to and through a plurality of aligned chambers 26 to interconnect a plurality of air passages 24.

As shown in FIG. 3, channels 28 preferably extend to the edges of each module 14, whether channels 28 cross one another or are aligned in a parallel relationship. When so configured, channels 28 also serve as pathways which collect and drain perspiration from under modules 14.

In a preferred embodiment, as shown in FIG. 1, membrane 16 is formed separately of modules 14, and is secured thereto after formation. Typically, membrane 16 is stitched to modules 14, as shown in FIG. 1, along necked-down or narrowed portions 15 of modules 14 formed on a perimeter of modules 14. The use of stitching adds flexibility and strength during movement, and modules 14 and membranes 16 can be made of different colors or designs.

Figure 4:
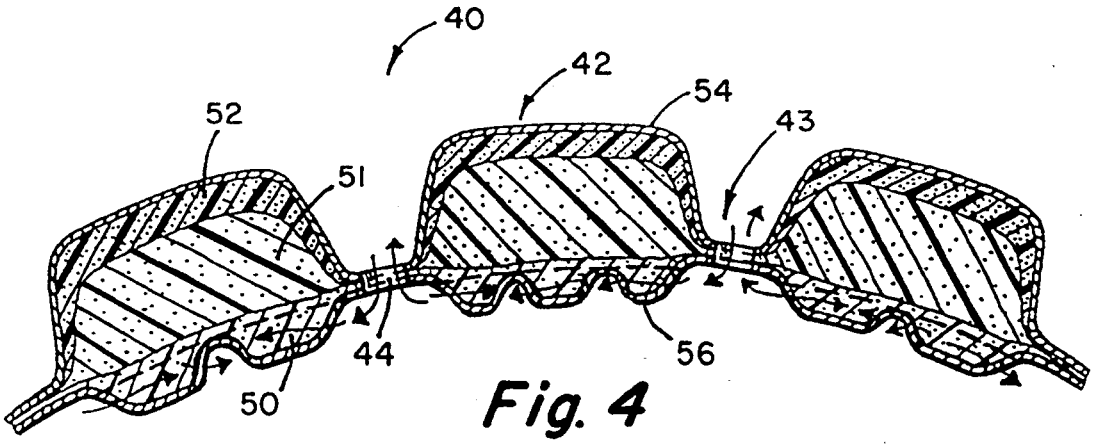
FIG. 4 is a cross-sectional view of another embodiment of the padding of this invention.

In an alternate embodiment, as shown in FIG. 4, upper layer 54 of modules 42 extends over membrane 43 and forms the upper layer thereof, while lower layer 56 extends over membrane 43 and forms the lower layer of both modules 42 and membrane 43. In this embodiment, modules 42 and membrane 43 are formed at the same time, and layers 54 and 56 are drawn tightly around the edges of modules 42. In this embodiment, membrane 43 may be formed of the same material as modules 42, although membrane 43 is thinner than modules 42.

Figure 18:
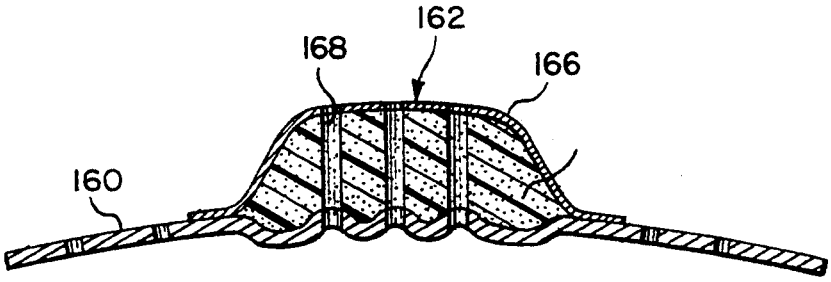
FIG. 18 is a cross-sectional side view of another embodiment of the module of this invention.
Figure 19:
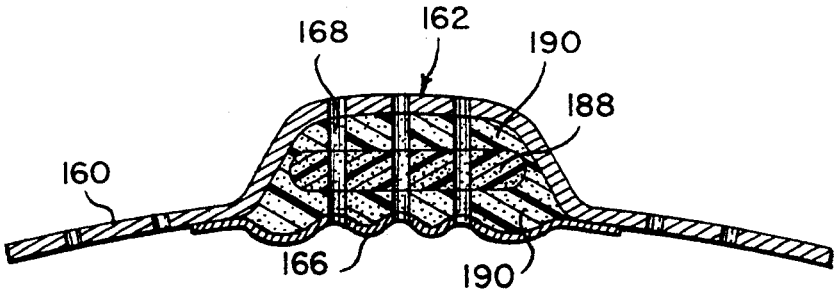
FIG. 19 is a cross-sectional side view of an alternative embodiment of the module of FIG. 18.

An alternative embodiment of the module of body padding 10 is illustrated in FIGS. 18 and 19, and includes membrane 160, module 162 having material 164 and web 166. Instead of modules 14 being stitched or otherwise secured to membrane 16, in FIGS. 18 and 19, membrane 160 is continuous and extends throughout body padding 10 without interruption. In FIGS. 18 and 19, modules 162 are formed by capturing interior material 164 between a surface of membrane 160 and a web 166 of fabric or other like material. Web 166 is stitched, heat sealed, glued or otherwise secured about the perimeter of material 164 to membrane 160 to capture material 164 between membrane 160 and web 166. Material 164 may be any one of the materials described below for material 11, or it may comprise an insert to be described hereinafter. In FIG. 18, membrane 160 forms a lower surface at each module 162 while web 166 forms the upper surface thereof. In FIG. 19, membrane 160 forms the upper surface of each module 162, while web 166 forms the lower surface thereof. In both FIGS. 18 and 19, air passages 168 are provided extending through module 162 from web 166 through membrane 160, as illustrated. In both embodiments, membrane 160 may be identical to membrane 16, and module 162 may be otherwise like module 14. Both embodiments typically are provided with a plurality of channels interconnecting air passages 168 on the lower surface of module 162, as previously described.

Material 11 typically comprises a molded foam material. In a preferred embodiment, material 11 is a closed cell foam. Typical polymers include cross-linked polyethylene, a polyurethane polymer, polyvinyl chloride, polypropylene, styrene or polyester. Preferred materials are cross-linked polyethylene and/or polyurethane. Additives such as EVA (ethylenevinylacetate) can be added to the polyethylene during the cross-linking process. Chemical and irradiative cross-linking can be used according to methods known to those of ordinary skill in the art.

Intermodular membrane 16 often provides most of the surface area of body padding 10. Typically, layer 22 of intermodular membrane 16 is formed of either an open cell or a closed cell foam. An open cell foam would be used if it is desired to enhance the breathability of the padding, while a closed cell foam would be used if it was desired to reduce the breathability of the padding. In one embodiment, layer 22 is formed of a perforated, closed cell neoprene sheet which is typically about 1.0 mm to about 3.0 mm in thickness. In another embodiment, layers 18 and 20 may be bonded directly together to form membrane 16, eliminating layer 22 entirely.

Layers 18 and 20 are formed of an elastic or stretch fabric. Preferably, layers 12 and 17 and layers 18 and 20 are breathable, although they need not all be breathable. In some embodiments, only layers 17 and 20 are breathable, while in other embodiments, none of layers 12, 17, 18 or 20 is breathable. If breathable materials are used for layers 18 and 20, typically layer 22 is breathable as well. Such a breathable layer 22 would be formed of either an open cell foam or some other nonbreathable material provided with multiple air passages. In a preferred embodiment, lower layers 17 and 20 are formed of a cotton-lycra blend, or a breathable fabric such as Cool-Max ® while upper layers 12 and 18 are formed of a nylon stretch fabric in an open weave. In another embodiment, upper layer 12 may be formed of a molded felt or nylon flock over a stretch fabric substrate, particularly when padding 10 is used for sports which utilize hardwood floors such as volleyball, basketball and ballet.

Upper layer 12 and lower layer 17 may be secured to material 11 within module 14 in any conventional manner. Suggested means of attachment include gluing, thermal bonding, or mechanical means such as stitching or sewing. In a preferred embodiment, layers 12 and 17 are heat and pressure bonded to material 11 of module 14 in a manner well known to those skilled in the art.

Figure 7:
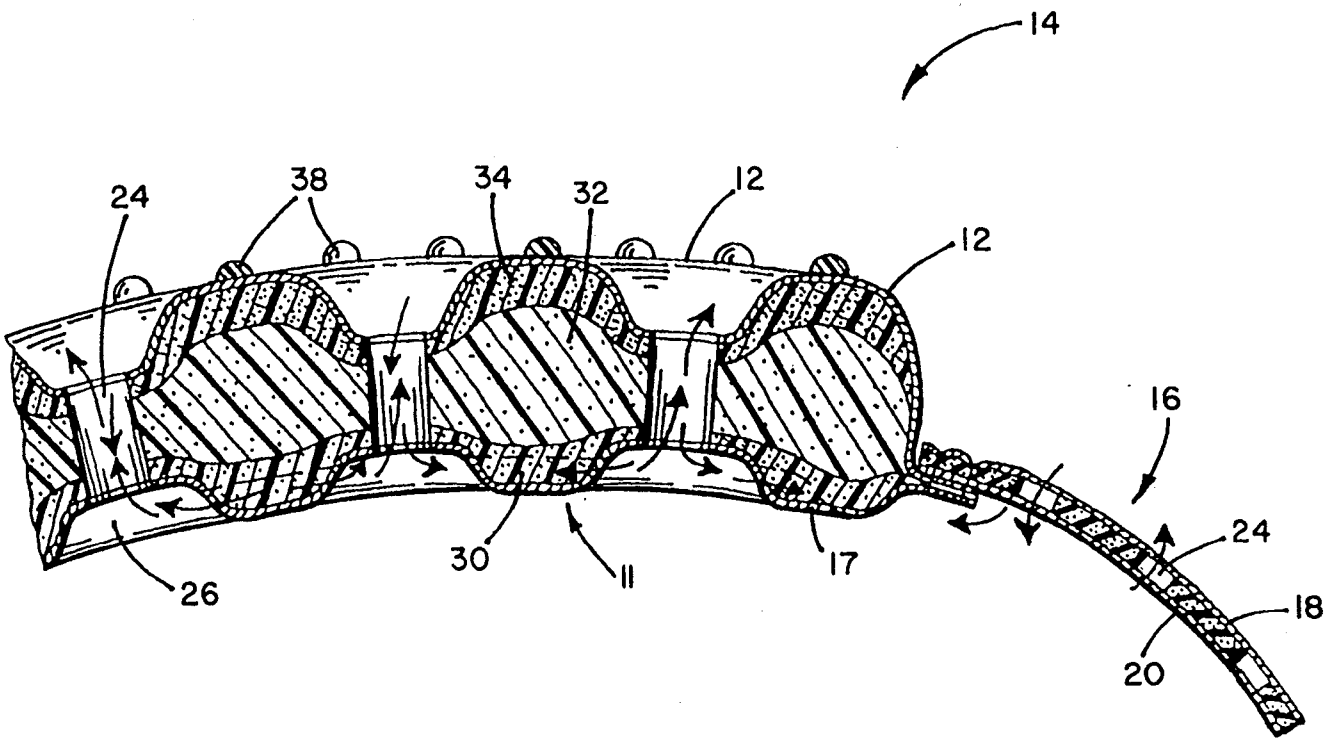
FIG. 7 is a cross-sectional view of another embodiment the body padding of this invention.
Figure 8:
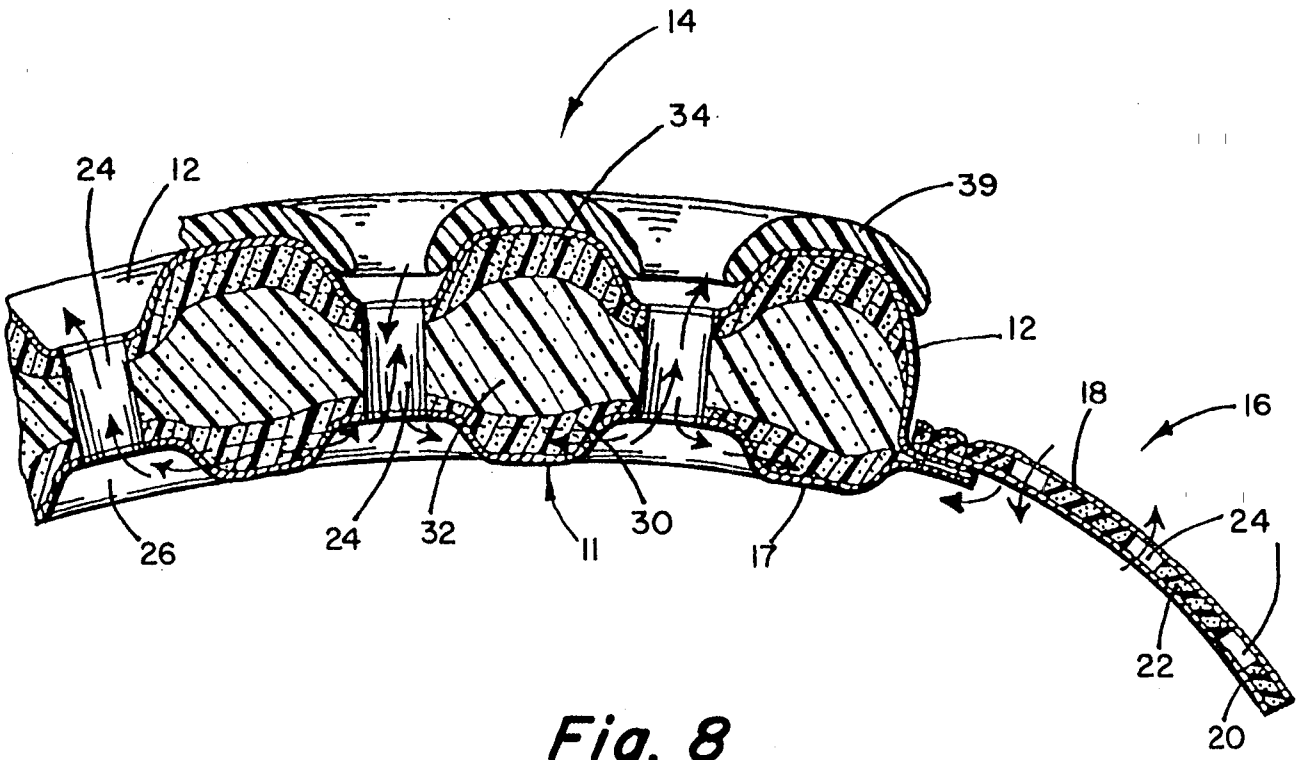
FIG. 8 is cross-sectional view of another embodiment of the body padding of this invention.

In a preferred embodiment, modules 14 are formed with varying flexibility such that the flexibility of material 11 decreases in a direction away from the surface of the body, or away from lower layer 17. Thus, the portion of module nearest the body is most flexible, while the portion adjacent upper layer 12 is the least flexible or most rigid. In one embodiment, this difference in flexibility can be achieved using different density foams. Typically the lower is the density of foam, the greater is the flexibility of the foam, and the greater the foam density, the greater is its rigidity. In another embodiment, this difference in flexibility can be achieved using foams of different chemical compositions. This structure is created using a plurality of distinct foam layers. Typically, module 14 has a tripartite distribution, comprising layers 30, 32 and 34, as shown in FIGS. 7 and 8. The structure of FIGS. 7 and 8 is similar no that of FIG. 1, and like numbers are used for like parts, where possible. A layer 30 of a flexible or a low density foam comprises the bottom portion of module 14. Layer 30 may be formed of a polyethylene cross-linked foam or an open cell flexible urethane foam and typically has a density of about 2–4 pounds per cubic foot. Central layer 32 is preferably a less flexible or a medium density cross-linked polyethylene foam, having a density of about 3–6 pounds per cubic foot. Layer 34 is formed of a more rigid or a high density foam and is the uppermost layer of module 14 closest to upper layer 12. Layer 34 typically is formed of a cross-linked closed-cell polyethylene foam, and typically has a density of about 6–11 pounds per cubic foot. Each of layers 30, 32 and 34 may also be formed of an open cell microporous PVC foam such as that sold under the trademark IMPLUS and having a density of about 10–35 pounds per cubic foot. In operation, layer 34 distributes a point impact to a larger area of padding 10, layer 32 has high shock absorbing properties and cushions the blow, and layer 30 both cushions and conforms to the body. Also, if layer 30, is an open cell foam, it helps enhance the breathability of the padding, as it permits some lateral gaseous communication between air passages 24 and the skin under layer 30.

The length and thickness of modules 14 can vary depending on the activity and body part which they are designed to protect. Preferably, the thicker regions of modules 14 are approximately 1 cm to about 3 cm thick. When a three layer construction is used, as shown in FIG. 7, in an exemplary embodiment, layer 30 is between about 0.318" to 0.635 cm thick, layer 32 is between about 0.476 cm to 0.635 cm thick and layer 34 is between about 0.318 cm to 0.635 cm thick.

Upper layer 12 of each module 14 may remain exposed as shown in FIG. 1, or it may be covered in some manner. A covering serves one or more of three different purposes. The first purpose is to provide a hard surface for wear resistance and to protect upper layer 12 of module 14. Another purpose is to provide each module 14 with a nongripping material on the surface thereof, so that modules 14, and thus padding 10, will slide upon any playing surface or other surface upon which it impacts to minimize frictional engagement between padding 10 and such a surface which would cause padding 10 to be pulled from the body or to be moved from its desired position on the body. A third purpose is to permit the use of reflective material to increase nighttime visibility.

Figure 9:
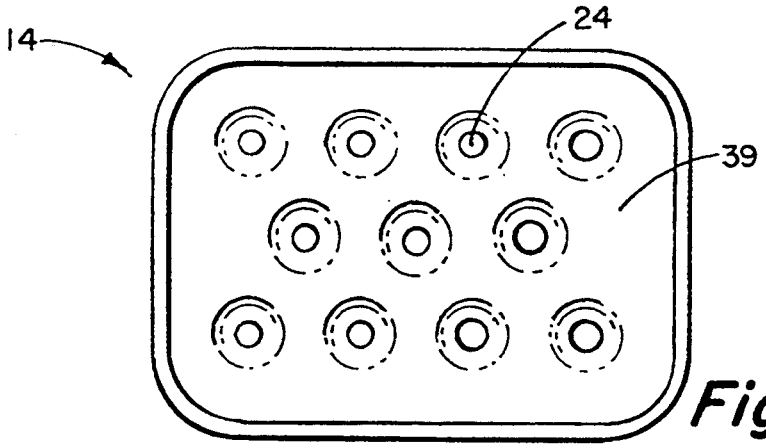
FIG. 9 is a top plan view of the body padding of FIG. 8.

In one embodiment, as shown in FIGS. 8 and 9, where parts similar to those in FIG. 1 have like numbers, upper layer 12 is covered by a cap 39 formed of rigid plastic. Cap 39 conforms to the upper surface of module 14, and includes openings formed therein overlying the upper termini of each of air passages 24 to permit the free flow of air through air passages 24. Cap 39 typically is formed of a high density polyethylene or ABS or other like plastic. In forming cap 39, once layer 12 is bonded onto material 11, molten plastic or resin is allowed to flow onto fabric 12, and thus the molten plastic or resin seeps between the fibers of layer 12 and hardens. The plastic can be applied in various patterns for graphic effect and provides a hard surface for wear resistance.

Figure 2:
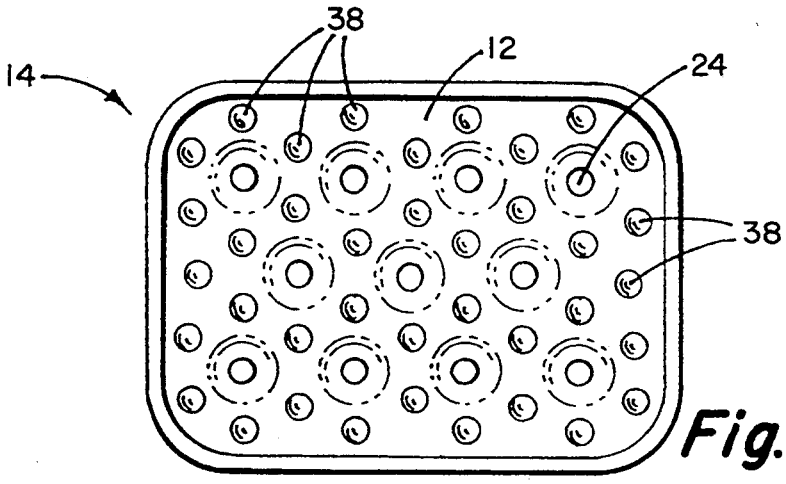

Another embodiment of module 14 is shown in FIGS. 2 and 7. In this embodiment, the surface of upper layer 12 is covered with a plurality of somewhat hard, impact resistant nodules or droplets 38 which are affixed thereto at positions designed not to interfere with the passage of air through air passages 24. Droplets 38 preferably are formed of plastic and may contain reflective material to permit padding 10 to be worn at night.

Figure 5:
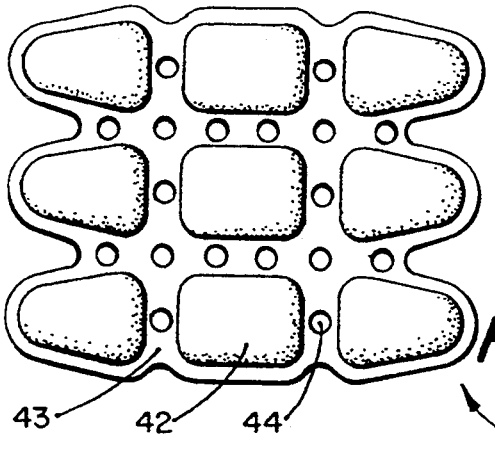
FIG. 5 is a top plan view of the padding module of FIG. 4.

Another embodiment of the padding of this invention will now be described with particular reference to FIGS. 4–6. In this embodiment, as in FIG. 1, padding 40 comprises a series of modules 42 interconnected by intermodular membranes 43. While three layers 50, 51 and 52 of foam are illustrated in FIG. 4, it is to be understood that this embodiment could be used with one, two or three or more layers of different foam. In this embodiment in contrast to prior embodiments, no air passages are provided through modules 42. Air passages 44 extend only through the intermodular membranes 43, as shown in FIGS. 4 and 5. In this embodiment, typically padding 40 is formed as a unitary body so that one or two of layers 50, 51 or 52 extends into membrane 43 and forms the central layer thereof. Upper layer 54 and lower layer 56 extend over both modules 42 and membrane 43 and are bonded to layers 50, 51 and 52 to capture them therebetween to form modules 42 and membranes 43. Alternatively, membranes 43 and modules 42 may be separately formed and stitched together.

Figure 6:
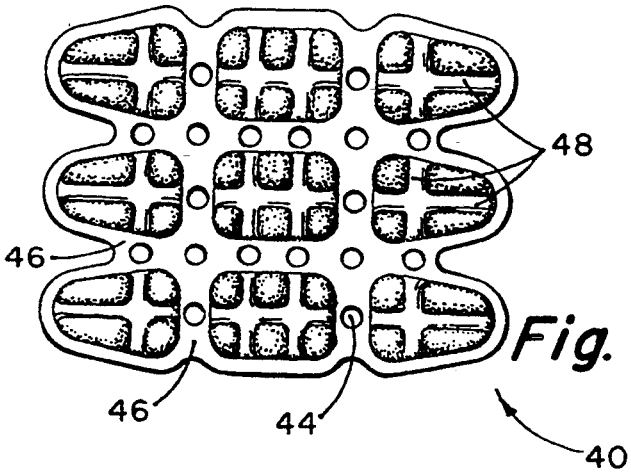
FIG. 6 is a bottom plan view of the padding module of FIG. 4.

As in previous embodiments, channels are provided on the lower surface of padding 40 to facilitate gaseous communication between the skin surface and air passages 44 to permit the escape of heat and moisture, as shown in FIG. 6. One set of channels 46 is formed beneath intermodular membrane 43 to interconnect the lower termini of air passages 44. Typically channels 46 are formed by spacing membrane 43 from the skin surface by locating membrane 43 at a position spaced from the lower surface of modules 42, but generally parallel thereto. Channels 46 are defined by the skin surface, membranes 43 and the lateral surfaces of modules 42, when padding 40 is applied to the body. A second set of channels includes a plurality of channels 48 which crisscrosses each module 42. Channels 48 communicate with channels 46 disposed beneath intermodular membrane 43 and thus with air passages 44. The embodiment of FIGS. 4 through 6 provides enhanced air flow adjacent the skin surface, and thus enhanced removal of heat and moisture therefrom.

A further aspect of this invention will now be described with particular reference to FIGS. 20–22. In this aspect of the invention, each module 170 is formed of an insert 172 disposed between two layers 173 and 175 which in turn are captured between layers 174 and 176 of a flexible material. Insert 172 typically is formed of a material that has a high repeat life so that it continues to return to as close to its original size as possible once compressed. In addition, insert 172 should continue to rebound or return to its original size over a long period of time. Examples include open or closed cell neoprene, a urethane foam, or open cell microporous PVC foam with a density of about 10 to 35 pounds per cubic foot, such as that sold under the mark IMPLUS. Insert 172 also may be formed of the same materials as material 11, as previously described, or it may have a structure to be described hereinafter. Layers 174 and 176 preferably either are generally parallel to or comprise the membrane which interconnects modules 170. For example, module 170 could have the structure shown in either FIG. 18 or FIG. 19. Alternatively, layer 174 could correspond to layer 12, while layer 176 could correspond to layer 17 in the module 14 of FIG. 1. Layers 174 and 176 are secured together around the perimeter of insert 172 to form module 170. Layers 174 and 176 are secured to one another by stitching, heat bonding, using an adhesive, or any other known manner.

A preferred structure and method for forming module 170 of FIG. 20 will now be described with particular reference to FIGS. 21 and 22. In this embodiment, module 170 is formed by placing the components of module 170 in a heated mold cavity and heat bonding together the various components of module 170 as described in FIG. 20. In this embodiment, preferably layers 173 and 175 are formed of a material which becomes soft and flows under the influence of heat at a temperature lower than the melting temperature or the softening temperature of insert 172. In this manner, during the bonding process, the material of layers 173 and 175 melts and flows around insert 172, so that when cooled, the material of layers 173 and 175 bond together the various elements of the sandwich which forms module 170. In addition, layers 174 and 176 can similarly be melted and heat bonded together, or they can be secured together with a heat activated adhesive. In one embodiment, layers 173 and 175 are formed of a cross-linked thermoforming elastomer, such as a two-pound polyethylene EVA. In this embodiment, preferably, insert 172 is formed of an open or closed cell neoprene, a urethane foam, or an open cell microporous PVC foam such as that sold under the mark IMPLUS.

Figure 21:
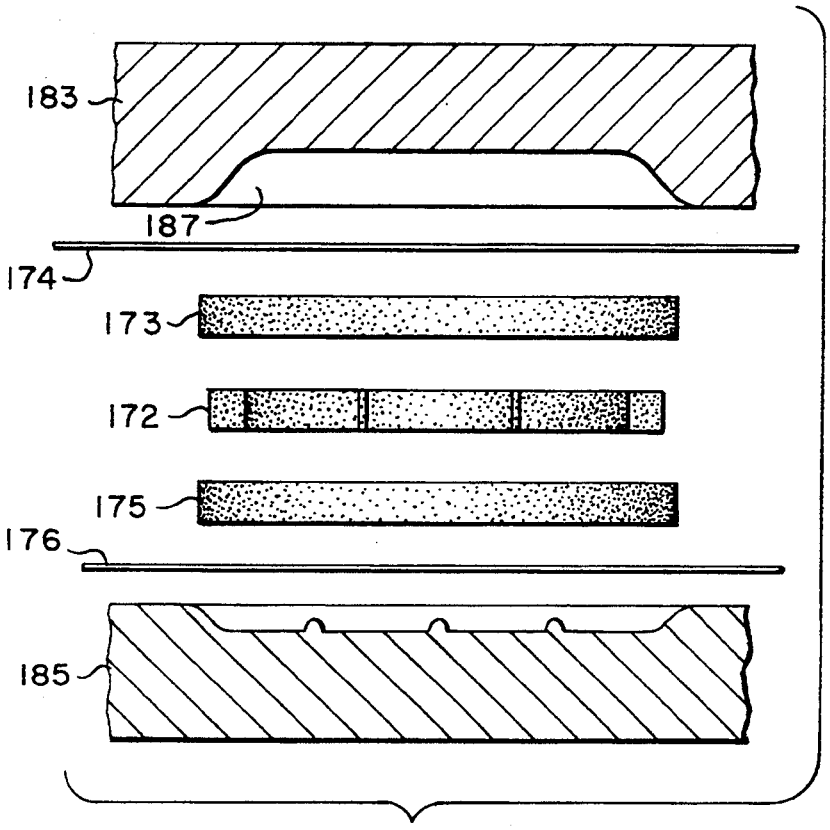
FIG. 21 is an exploded, cross-sectional view of the embodiment of FIG. 20 illustrating the mold and manner of assembly.
Figure 22:
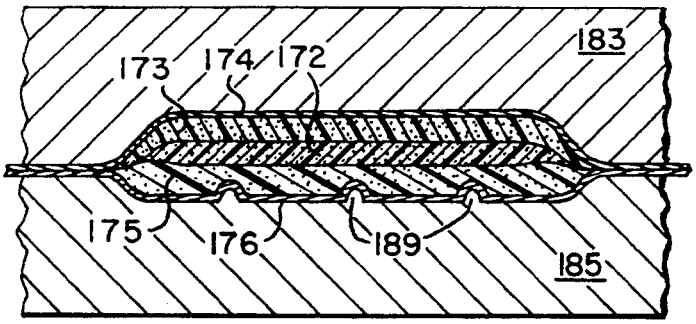
FIG. 22 is a cross-sectional, side view of the assembled module of FIG. 20 in a closed mold.

In this embodiment, typically layers 173,174, 175 and 176, along with insert 172 are placed between two halves of a mold 183 and 185, as shown in FIGS. 21 and 22. Module 174 is formed by bringing halves 183 and 185 together and heat and pressure bonding the components together as described. To allow sufficient room for the material of layers 173 and 175 to flow around insert 172 to capture insert 172 therebetween, space must be provided around the perimeter of insert 172. Thus, insert 172 must be formed having a slightly smaller length and width than layers 173 and 175, and a smaller length and width than that of the cavity 187 formed in mold halves 183 and 185. As a result of this requirement, the placement of insert 172 within the mold is somewhat difficult. If insert 172 is not precisely centered in mold cavity 187, module 170 would not be symmetric, and would have portions in which the force of an impact thereon would not be absorbed or buffered by insert 172. Also, during the period of time that mold halves 183 and 185 are being brought together, movement of insert 172 parallel to layers 174 and 176 could occur, thus causing an undesired offset of insert 172.

To overcome this centering and placement problem, and to prevent movement of insert 172 during the molding process, insert 172 is provided with a plurality of flexible fins 178 arrayed about its outer perimeter. Each fin 178 preferably extends the same distance from the outer surface of insert 172, and fins 178 each may have the same vertical extent as the thickness of insert 172, although they need not. Fins 178 typically extend from insert 172 in a direction which is generally perpendicular to the outer surface of insert 172 from which they extend. Preferably, fins 178 extend to a distance such that when insert 172 is placed within mold cavity 187, fins 178 are all within mold cavity 187, but extend just to the inner surface thereof at all locations around the perimeter of mold cavity 187. In this manner, insert 172 is readily centered by the manual placement of insert 172 within mold cavity 187, and no movement of insert 172 is permitted during the molding process. As a result, each module 172 is symmetrically formed having an insert 172 disposed in the middle thereof, and having material from layers 173 and 175 sealed together about the outer perimeter of insert 172.

Module 170 in its assembled, molded condition is shown within mold halves 183 and 185 in FIG. 22. In the method of forming module 170, as illustrated in FIGS. 21 and 22, a sandwich is created between mold halves 183 and 185 by first placing layer 176 into mold half 185, and then placing layer 175, insert 172, layer 173 and layer 174 successively on top of layer 176. Thereafter, mold halves 183 and 185 are heated, and brought together to form the assembled module 170, as shown in FIG. 22. Preferably, mold half 185 is provided with ridges so that the channels 189 which communicate with air passages are formed on the lower surface of module 170.

Once module 170 has been formed, air passages 182 may be provided by use of punches which, when properly aligned, create holes in communication with channels 189. These air passages 182 extend entirely through layer 174, layers 173 and 175, insert 172 and layer 176.

Figure 20:
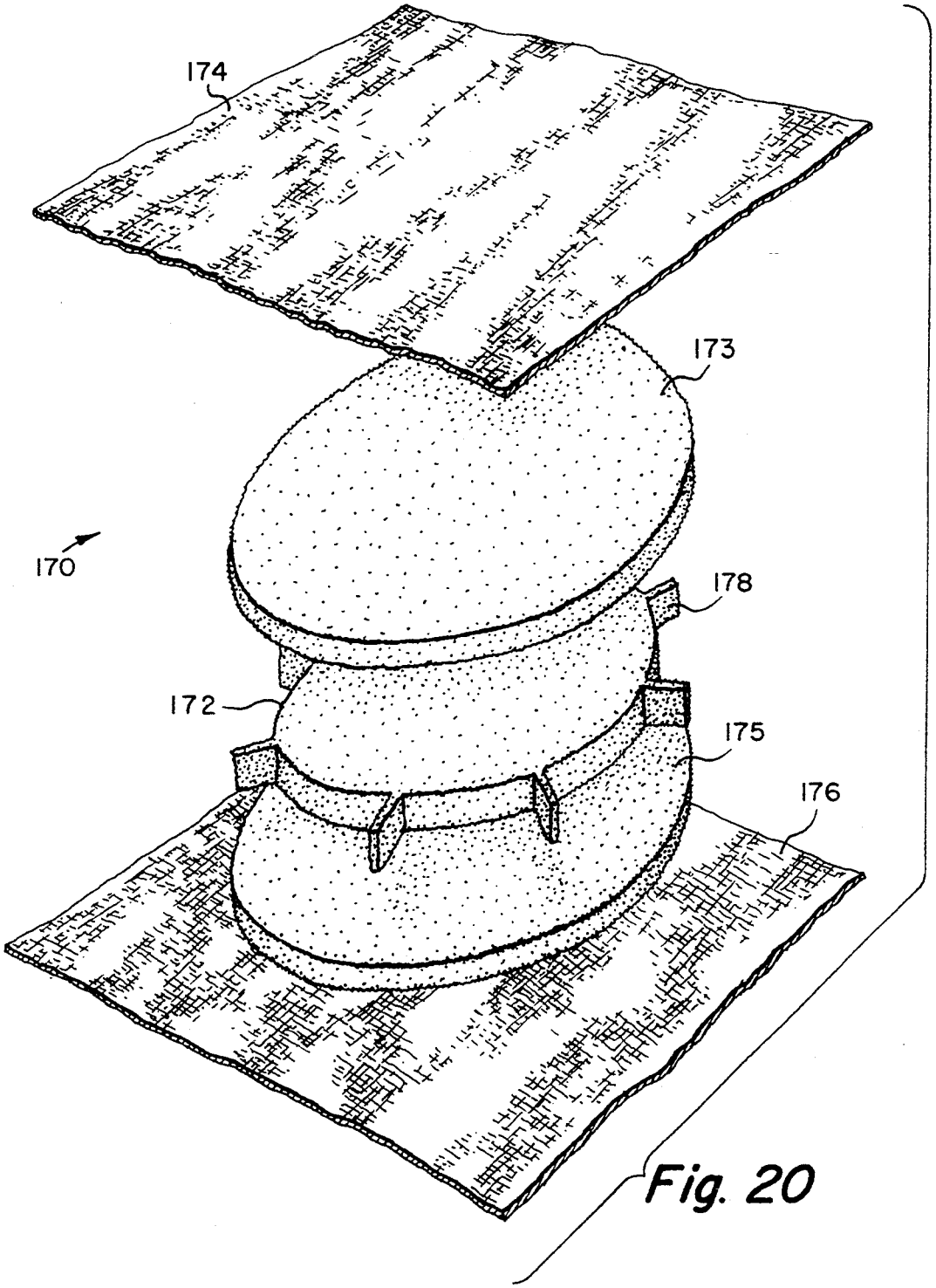
FIG. 20 is an exploded, perspective view illustrating another embodiment of the module of this invention.
Figure 23:
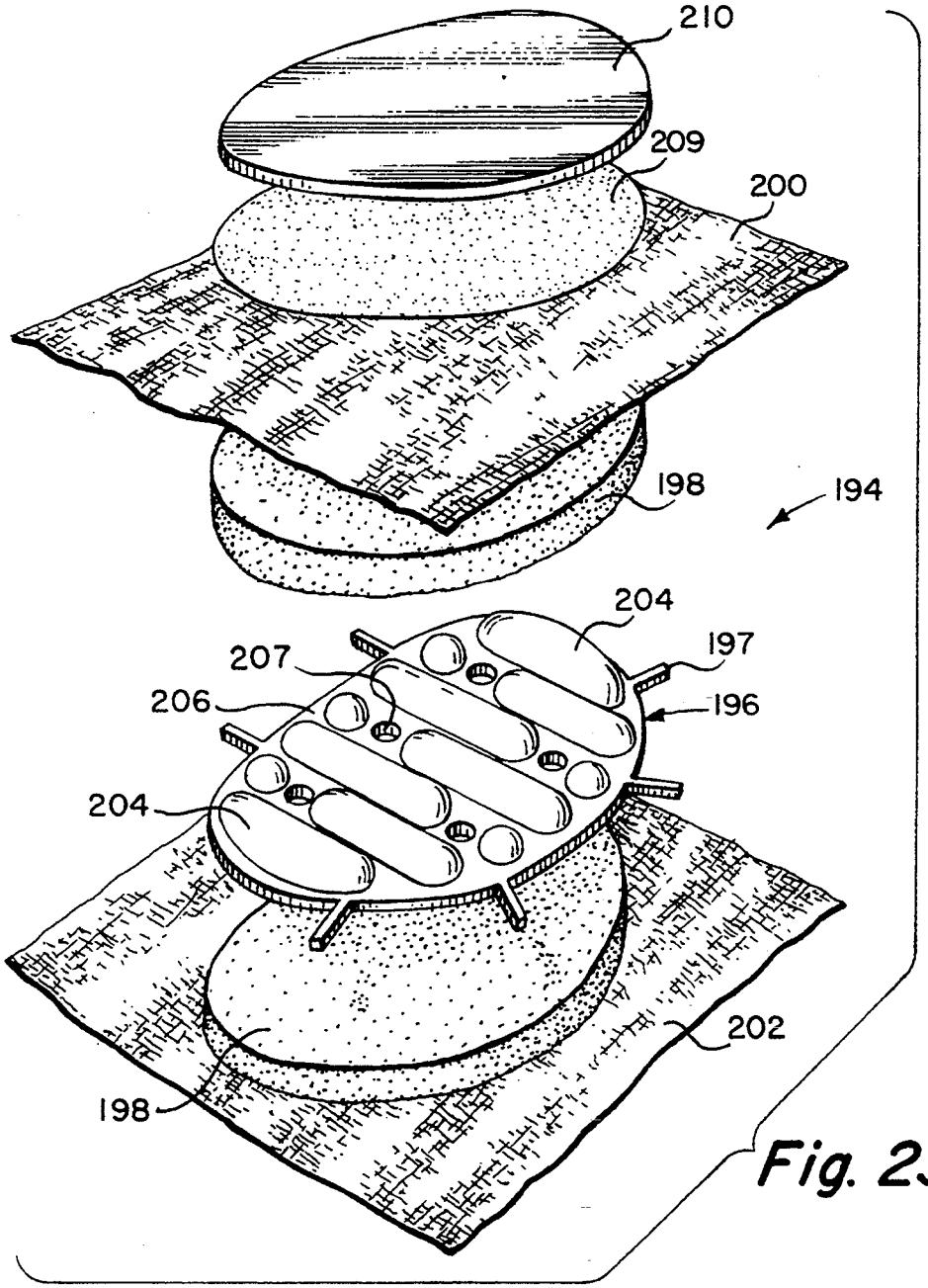
FIG. 23 is an exploded, perspective view of another embodiment of the module of FIG. 20.
Figure 24:
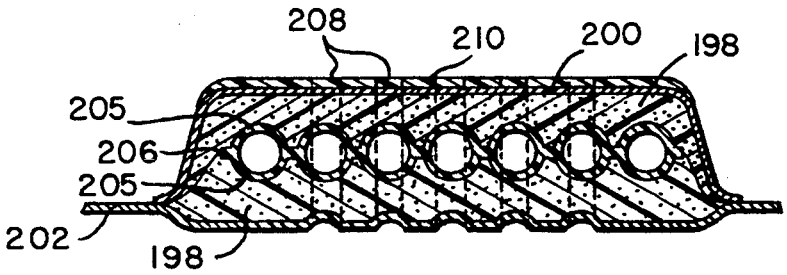
FIG. 24 is a cross-sectional side view of the assembled module of FIG. 23.

FIGS. 23 and 24 illustate another embodiment of the concept of FIGS. 20–22. Module 194 of FIGS. 23 and 24 includes a central insert 196 surrounded by two layers of foam 198 which in turn are disposed between layers 200 and 202 of material. One of layers 200 and 202 may be the membrane, while the other may be a layer of fabric bonded thereto, as described with respect to FIGS. 18 and 19, or layers 200 and 202 may be layers of fabric which are bonded together and which are both secured thereafter to the membrane (not shown). Alternatively, layers 200 and 202 also may form the top and bottom layers of the membrane. Insert 196 is formed of a plurality of enlarged portions 204 interconnected by web 206. Typically, enlarged portions 204 are also elongated, and are aligned generally parallel with one another in their direction of elongation. Alternatively, enlarged portions 204 may be a plurality of generally circular elements which have no particular orientation. Enlarged portions 204 may be either gas chambers in which air is captured (FIG. 24), or they may comprise a foam bubble. Preferably, insert 196 is provided with fins 197 which are similar to fins 178.

if enlarged portions 204 are gas chambers, (FIG. 24) insert 196 is typically formed using two layers 205 of film between which air or some other gas is introduced. Layers 205 of film are sealed together by adhesive, heat or other like means to form web 206. The enlarged portions 204 comprising gas chambers are formed in the areas where the two layers of material are not sealed together. Typically, in this embodiment, insert 196 is formed of a flexible plastic film such as urethane.

If enlarged portions 204 are formed of a solid or foam material, a preferred material is a molded neoprene or urethane. The urethane should be a high rebound, resilient urethane, while the neoprene could be either an open or closed cell material. However, a closed cell neoprene is preferred.

Layers 198 are formed of the same material as layers 173 and 175, and module 194 is assembled in the same manner, as previously described for module 170. Thereafter, air passages 208 are formed in the usual manner. The process is designed such that air passages 208 only pass through web 206 of insert 196, and not through enlarged portions 204. Web 206 may even have holes 207 (FIGS. 23) pre-punched prior to construction of module 194 to facilitate the formation of air passages 208. If holes 207 are pre-punched, proper alignment of insert 196 within the mold is particularly important. When assembled, as shown in FIG. 23, layers 198 capture insert 196 tightly therebetween, and layer 200 is tightly secured to layer 202 to form an integral, sealed, longlasting module 194.

In a further embodiment of this invention, a hardened shell 210 may be secured to layer 200 on the outer surface of module 194. Typically, shell 210 is secured using a layer 209 of adhesive, such as a cross-linked thermally activated adhesive. Shell 210 may be formed of the same material as cap 39, such as high density polyethylene or polypropylene. When shell 210 is secured to module 194, module 194 may still be formed using a heated mold 183 and 185 as described with respect to FIGS. 21 and 22. Shell 210 is placed within the mold in the desired location and the heat activates adhesive layer 209.

The provision of inserts, such as insert 196, 188 or 172 provides a longer life for the modules and greater rebound. This type of construction is particularly advantageous for high contact sports or any situation in which the modules are subjected to repeated, high impact blows.

When shell 210 is used in conjunction with the structure of FIG. 23, typically air passages 208 are not formed until after shell 210 has been secured to layer 200. In this circumstance, a punch must strike shell 210, and all of module 194 with sufficient force to punch an air passage 208 through shell 210 and all the way through layers 200, 198 and 202 and insert 196. In a preferred embodiment, shell 210 is not provided with a great thickness, so that the body padding retains its light weight and so that module 194 is not unacceptably rigid. Typically, shell 210 has a thickness of approximately 1/16 of an inch. Therefore, as the punch strikes shell 210 to produce air passages 208, the force with which it strikes shell 210 can weaken shell 210 or even fracture it, thus significantly reducing the life and effectiveness of the body padding.

Figure 25:
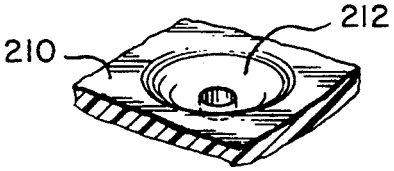
FIG. 25 is a perspective view showing one embodiment of a reinforced air passage opening.
Figure 26:
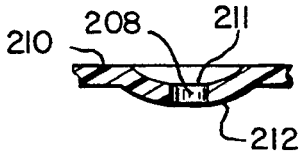
FIG. 26 is a cross-sectional side view of the reinforced opening of FIG. 25.

The above-described problem can be overcome by strengthening shell 210. FIGS. 25–30 illustrates three different embodiments for strengthening shell 210. In FIGS. 25 and 26, a reverse compound curve or dip or dimple 212 is provided in a location where the opening for air passage 208 is to be punched. A flat area 211 is provided at the bottom of dimple 212 where the punch is to contact shell 210.

Figure 27:
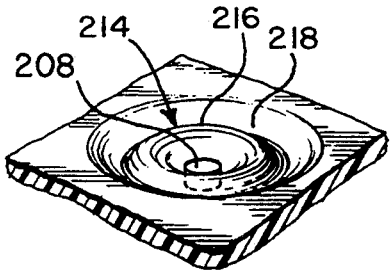
FIG. 27 is a perspective view showing another embodiment of the reinforced air passage opening of this invention.
Figure 28:
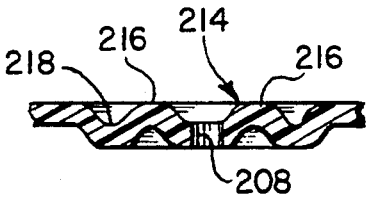
FIG. 28 is a cross-sectional side view of the opening of FIG. 27.

In FIGS. 27 and 28, circular ripple 214 is provided concentric with the opening for air passage 208. Ripple 214 provides somewhat greater structural strength than dimple 212 of FIGS. 25 and 26. A plurality of ripples 214 could be provided, if additional strength is required. Each ripple 214 would be concentric with the opening for air passage 208 and would be spaced radially from the center of the air passage. Each ripple 214 has a raised shoulder 216 adjacent air passage 208, and a trough 218 on the opposite side of ridge 216 from air passage 208. The opening for air passage 208 is disposed in a flattened, depressed area within shoulder 216.

Figure 29:
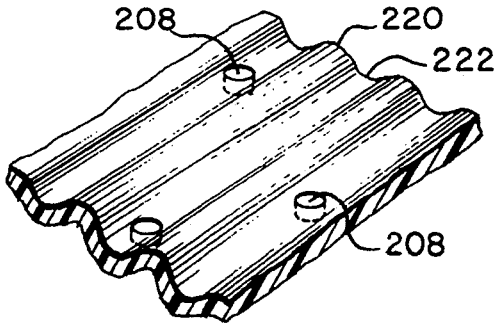
FIG. 29 is a perspective view showing another, further embodiment of the reinforced air passage opening of this invention.
Figure 30:
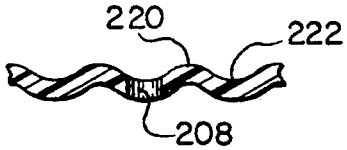
FIG. 30 is a cross-sectional end view of the embodiment of FIG. 29.

Another embodiment is illustrated in FIGS. 29 and 30 in which a plurality of generally parallel, alternating ridges 220 and troughs 222 is provided. The openings for air passages 208 are preferably punched at locations in troughs 222. For this purpose, typically the lower portion of each trough 222 is somewhat flattened to facilitate the punching of air passages 208.

It is to be understood that each of the embodiments illustrated in FIGS. 18–24 includes air passages and channels on the underside thereof which correspond to air passages 24 and channels 28 of the embodiment of FIG. 1.

Figure 10:
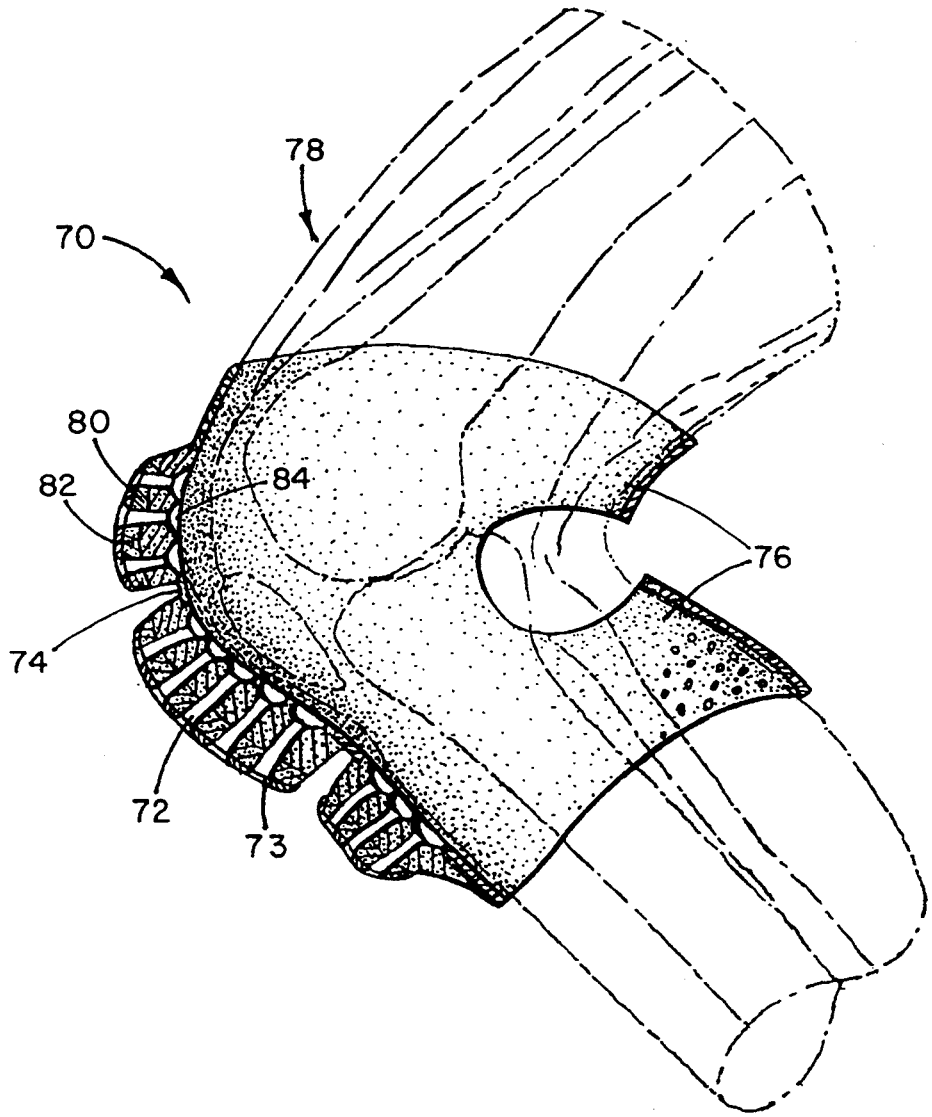
FIG. 10 is a side view of a flexed human knee showing the body padding of this invention in cross section.

The padding modules and the intermodular membrane of this invention may be arranged in any configuration to provide for specific protection to vulnerable areas, and to provide the articulation required by a particular body part. For example, a knee guard 70 is shown in FIG. 10 and comprises modules 72 interconnected by membrane 74. A further elastic membrane 76 surrounds the knee joint 78 and retains guard 70 in place on knee joint 78. Membranes 74 and 76 may be formed of the same material, or membrane 76 may be formed of a different, higher power elastic material than membrane 74. Each module 72 comprises a layer 80 of foam sandwiched between upper 82 and lower 84 resilient layers, as described above. When the joint is flexed, articulation of guard 70 is permitted by membrane 74 to permit guard 70 to conform to movements of joint 78 and to cause modules 72 to be in the proper position to receive an impact. Air passages 73 allow venting of heat and moisture from the skin as described.

Figure 11:
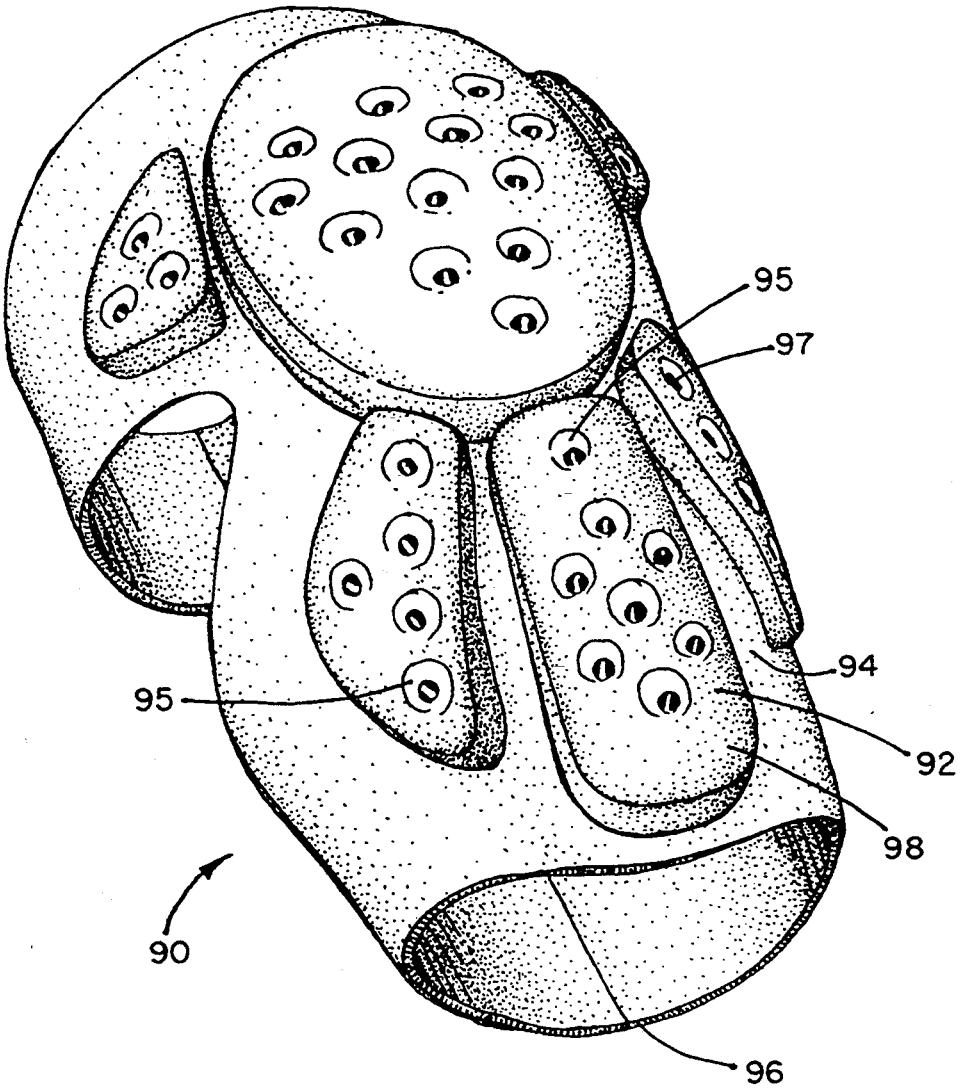
FIG. 11 is a perspective view of another embodiment of a knee guard utilizing this invention.

FIG. 11 shows a perspective view of another embodiment of a knee guard 90 of this invention. Knee guard 90 has a plurality of modules 92 dispersed within intermodular membrane 94, and membrane 96 surrounds the knee. In this embodiment, a rigid plastic cap 98 covers the upper surface of modules 92. Breathability is provided by air passages 97 which pass through modules 92, and which have upper termini communicating with recessed depressions 95 in cap 98. Air passages 95 may also be provided in membrane 96 to improve breathability.

Figure 12:
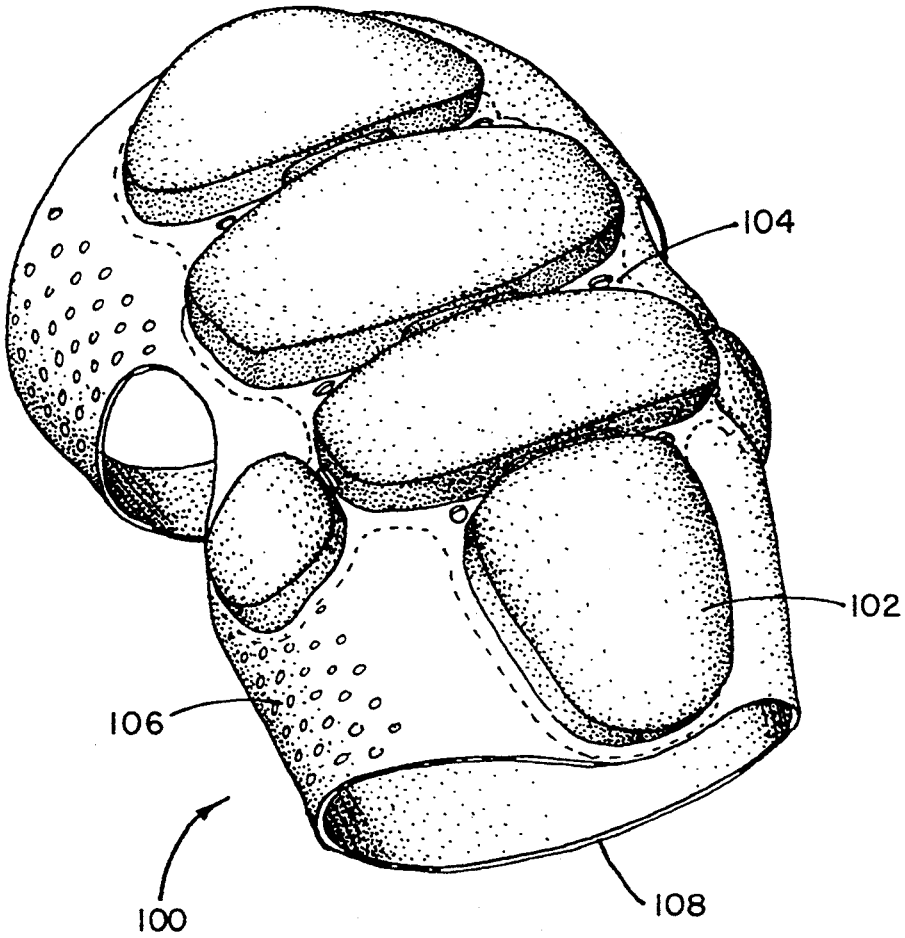
FIG. 12 is a perspective view of yet another embodiment of a knee guard utilizing this invention.

Another embodiment of a knee guard 100 is shown in FIG. 12. Knee guard 100 includes modules 102 separated by intermodular membranes 104, which membranes contain a plurality of air passages 106. Membrane 108 surrounds the knee and contains air passages 106. No air passages are provided in modules 102.

Figure 13:
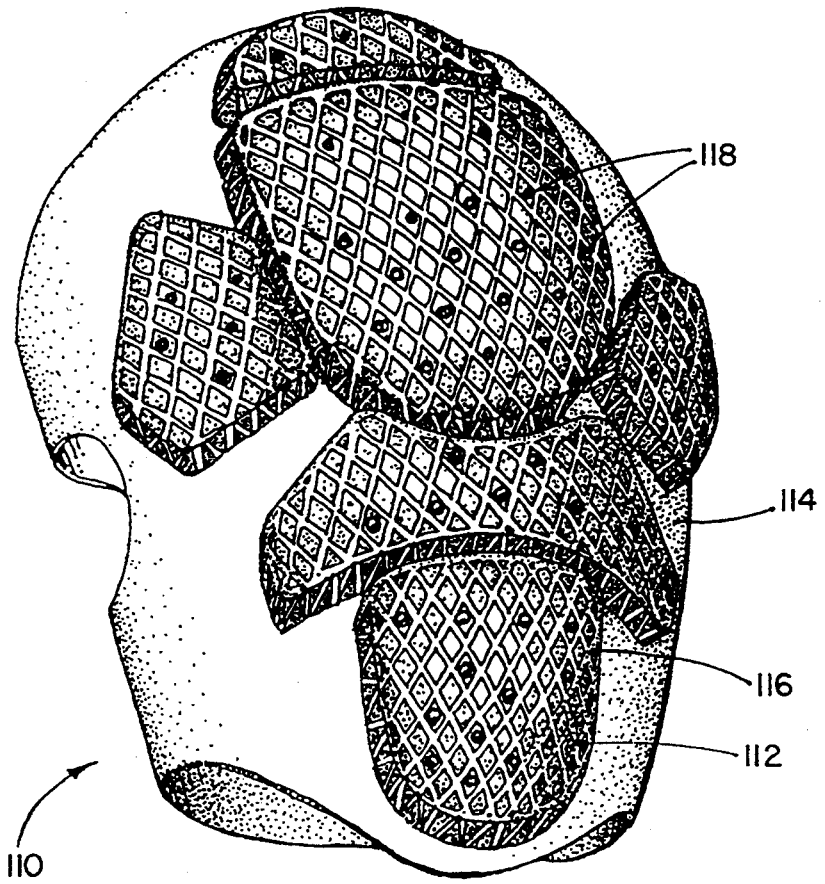
FIG. 13 is yet another embodiment of a knee guard utilizing this invention.

FIG. 13 illustrates a knee guard 110 having modules 112 and membrane 114. Modules 112 are covered by an upper layer 116 of an open mesh construction. Preferably, layer 116 is sufficiently flexible to conform to the three-dimensional shape of modules 112. Layer 116 can be made of high-carbon fiber mesh or stretch nylon mesh material such as Cordura® nylon. Air passages 118 extend through modules 112 and communicate with the environment through openings in layer 112.

Figure 14:
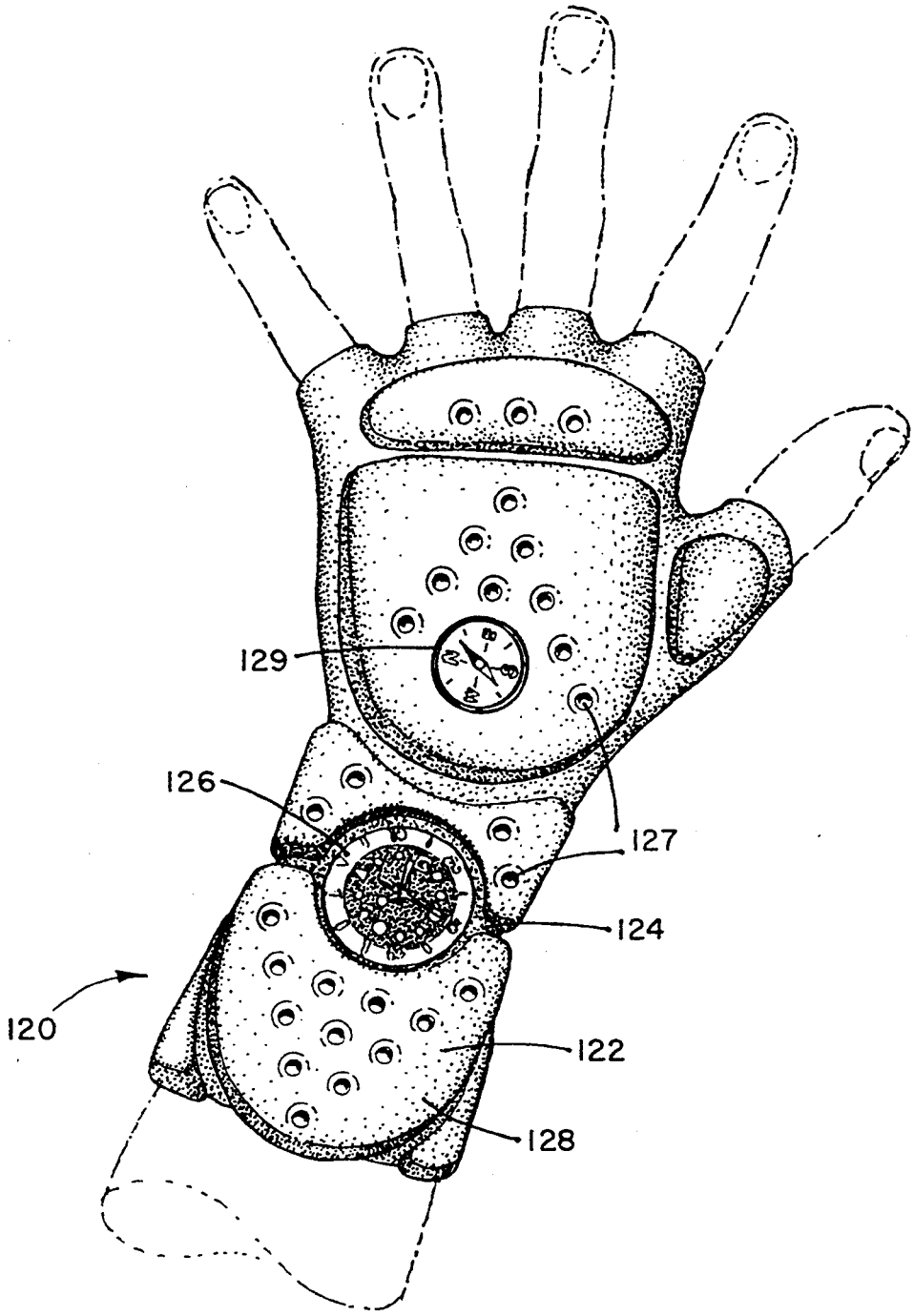
FIG. 14 is a top plan view of a wrist and hand guard utilizing the padding of this invention.

To protect the wrist, a wrist guard 120 may be fabricated as shown in FIG. 14. Wrist guard 120 is designed to slip over the hand and onto the wrist, and is comprised of modules 122 with relatively small intermodular membrane 124. A watch or other time keeping device 126 and/or a compass 129 can be integrated into the upper surface of the protective wrist guard 120. This embodiment also illustrates rigid cap 128 which is affixed to the upper surfaces of modules 122 and which is designed to provide abrasion resistance. Air passages 127 pass through modules 122 and cap 128. Cap 128 is not necessary and can be eliminated, as can device 126 and compass 129.

Figure 15:
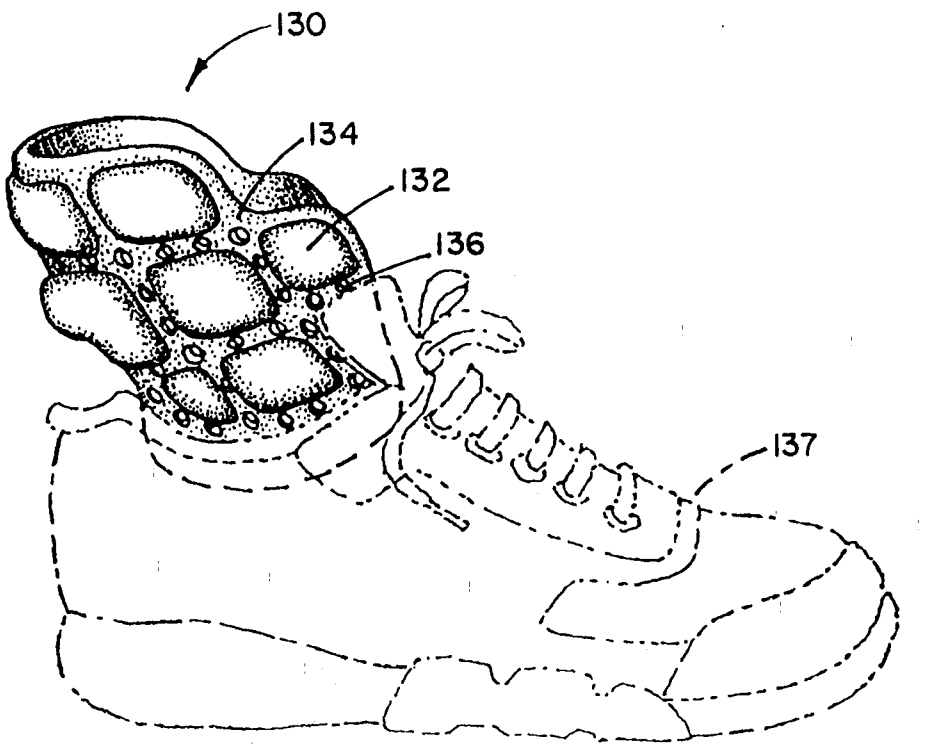
FIG. 15 is a perspective view of an ankle guard utilizing the padding of this invention.

FIG. 15 illustrates one embodiment of an ankle padding 130 of the invention having modules 132, membrane 134 and air passages 136. Membrane 134 is formed on tapered sections extending between adjacent foam modules 132. Membrane 134 and modules 132 may have a structure like that of any one of the structures described in FIGS. 1–9 and the accompanying text. Padding 130 may be attached to the upper opening of a shoe 137 as shown.

Figure 16:
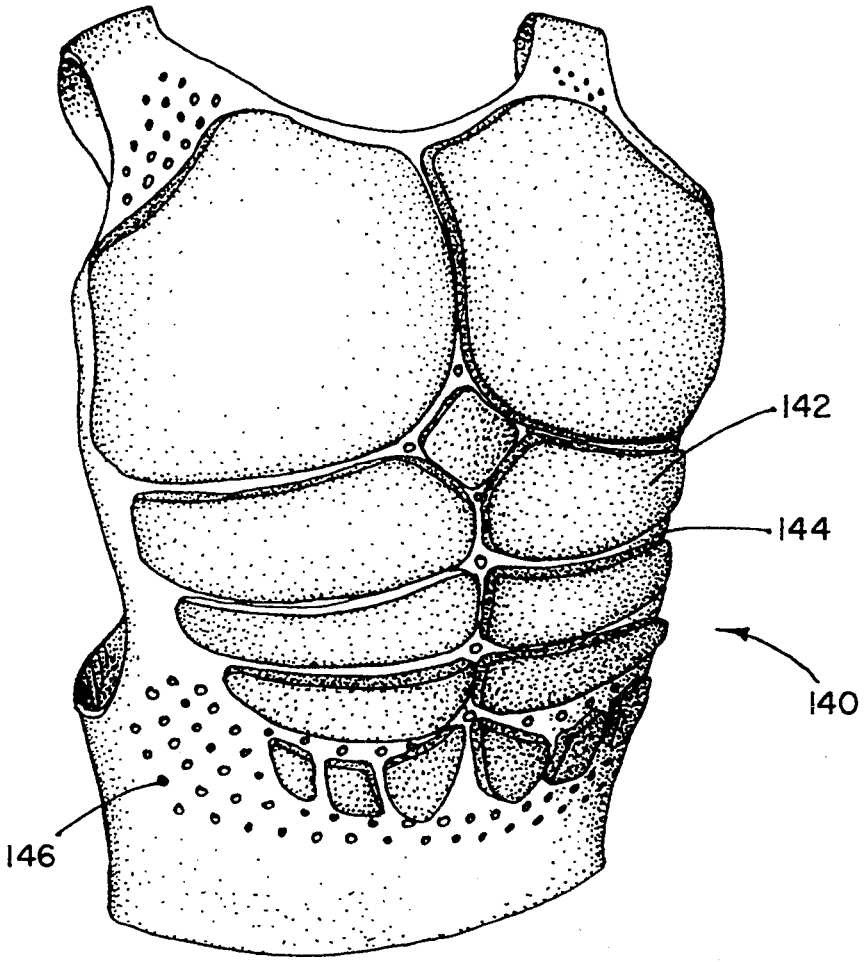
FIG. 16 is a perspective view of a chest protector utilizing this invention designed primarily for body surfing.

The outer surface of the padding of this invention can be covered with patterns or fabrics or embossed forms to enhance the aesthetic and fashion expression thereof. For example, the padding can be displayed in different colors and in different configurations to simulate various desired objects or body features. FIG. 16 illustrates an embodiment of a vest 140 for use in bodysurfing. Vest 140 includes modules 142 interconnected by membrane 144 having air passages 146. Modules 142 are configured to simulate a body builder's muscles. Modules 142 add buoyancy, which provides an added safety feature, as well as improves the performance for body surfers. Modules 142 and membrane 144 may have a structure like that of any one of the structures described in FIGS. 1–9, and the accompanying text. The identity of manufacturer's brand names and the like can be easily embossed or graphically displayed on vest 140.

Figure 17:
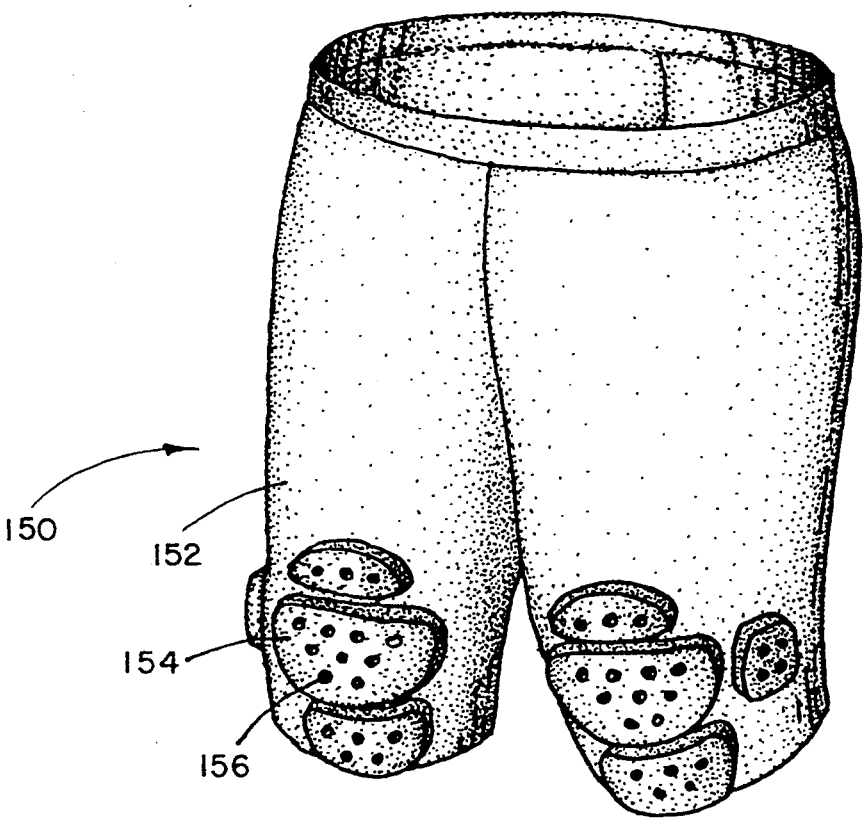
FIG. 17 is a perspective view of an item of clothing incorporating the padding of this invention.

The body padding of this invention also can be incorporated into items of clothing which are worn on the body. An example of such clothing is shown in FIG. 17 which illustrates the use of this invention in conjunction with a pair of stretch pants 150. Pants 150 include modules 154 located at strategic points on the surface of membrane 152 which forms the material of pants 150. Modules 154 are stitched to membrane 152, or are captured between layers of membrane 152. Portions of membrane 152 are disposed between each module 154 and connect the modules. Preferably, each module 154 is provided with a plurality of air passages 156. Modules 154 each may have any one of the structures of the modules described in FIGS. 1–9 and the accompanying text. Pants 150 can be similar to any conventional stretch pants used for bicycling or running which are well known in the art. A typical material used to form pants 150 and thus membrane 152 is lycra. The concept of FIG. 17 can be applied equally to shirts, longer pants and other types of clothing.

It is to be understood that the modules and membranes of the embodiments described above for FIGS. 10–17 could either have the structure described above, or they could have the structure shown and described in any one of FIGS. 18–23.

The padding of this invention can be configured in any shape and be provided in any color or design desirable. The padding can be made to conform to current fashion demands, thus rendering it fashionable to young people who would otherwise not want to wear protective body padding.

The body padding of this invention can be configured to protect a multitude of body parts such as knees, ankles, wrists, elbows, chests, shoulders, backs, hips, heads and shins. Body padding can be worn in a wide variety of activities including, but not limited to: baseball, basketball, football, volleyball, ice hockey, field hockey, soccer, lacrosse, tennis, racquetball, handball, squash, wrestling, rugby, on-road and off-road biking, roller blading, roller skating, skateboarding, windsurfing, and surfing.

In view of the above description, it is likely that modifications and improvements will occur to those in the art which are within the scope of this invention. The above description is intended to be exemplary only, the scope of the invention being defined by the following claims and their equivalents.

What is claimed is:

1. Articulated body padding comprising:

a plurality of module formed of foam material, each of said modules having an upper surface and a lower surface, said lower surface being adapted to be adjacent to a surface of a body;

an elastic membrane interconnecting said modules, said membrane having an upper surface and a lower surface, said membrane being directly secured to at least some of said modules; and a plurality of air passages, said air passages extending from and through said upper surface to and through said lower surface of at least a selected one of said modules and said membrane to provide direct gaseous communication between the surface of the body and an environment surrounding the body.

2. The articulated body padding of claim 1 wherein each module comprises an insert having an air pocket formed therein.

3. In a body padding comprising a plurality of modules, an elastic membrane interconnecting each of said modules and a plurality of air passages extending through at least one of said modules and said membrane, a method for forming said modules comprising the steps of:

placing an insert between an upper layer of material and a lower layer of material in a mold cavity between two halves of a mold;

providing fins on said insert, said fins extending outwardly from said insert in a direction generally parallel to said upper and lower layers of material to allow centering of said insert in said mold; and bringing together the halves of said mold cavity and heating said mold to secure said upper layer of material to said lower layer of material around a perimeter of said insert, said fins inhibiting movement of said insert in a direction generally parallel to said upper and said lower layers of material; and melting a material which flows around said fins and around the perimeter of said insert to bond together said upper and lower layers of material and to capture said insert therebetween.

4. Body padding comprising:

a plurality of modules, each of said modules comprising:

an upper layer formed of a flexible material;

a lower layer formed of a flexible material;

a middle layer having fins extending outwardly therefrom around a perimeter to prevent movement of said middle layer during assembly; and heat activated material which flows around the perimeter of said middle layer and around said fins to bond together said upper and lower layers of material around the perimeter of said middle layer; and an elastic membrane interconnecting said modules, said membrane having an upper layer and a lower layer.

5. The body padding of claim 4, further comprising a plurality of air passages, said air passages extending from said upper layer to said lower layer of at least one of said modules and said membrane.

6. The body padding of claim 4 wherein said middle layer includes air pockets.

7. The body padding of claim 4 wherein said upper layer of material of each of said modules comprises said elastic membrane.

8. The body padding of claim 4 wherein said lower layer of material of each of said modules comprises said elastic membrane.

9. The body padding of claim 4 wherein said middle layer comprises:

an upper layer of film;

a lower layer of film secured to said upper layer only in selected areas;

pockets of air captured between said upper and lower layers of film, in areas other than said selected areas.

10. The body padding of claim 4 further comprising a hardened shell secured to said upper layer of each of said modules.

11. The body padding of claim 10 further comprising:

a plurality of air passages extending completely through each of said modules from an upper surface of said hardened shell through said lower layer of material;

an opening for each of said air passages disposed on said upper surface of said hardened shell; and reinforcing means disposed adjacent each of said openings of said air passages on said upper surface of said shell.

12. The body padding of claim 11 wherein said reinforcing means comprises a recess surrounding each of said openings.

13. The padding of claim 12 wherein said reinforcing means comprises a concentric ridge surrounding each of said openings.

14. The body padding of claim 11 wherein said reinforcing means comprise a plurality of generally parallel ridges and troughs formed on said upper surface of said shell, said openings being disposed in said troughs.

15. Articulated body padding comprising:

a plurality of foam modules each having an upper surface and a lower surface;

a first membrane having an upper surface and a lower surface and interconnecting adjacent ones of said modules, said modules being rigid relative to said first membrane, said first membrane being sufficiently flexible and stretchable to allow bending and stretching thereof in response to movement of a body part; and a second, elastic membrane having an upper surface and a lower surface, said second membrane being secured to at least one of said modules and being adapted to extend around at least a portion of a body part.

16. The articulated body padding of claim 15, further comprising air communication means disposed on said lower surface of at least a selected one of said modules, said first membrane and said second membrane.

17. The articulated body padding of claim 15, further comprising a plurality of air passages, said air passages extending between said upper surface and said lower surface of at least a selected one of said modules, said first membrane and said second membrane.

18. The articulated body padding of claim 15, wherein said second, elastic membrane comprises a layer of foam secured to at least one layer of stretch fabric.

* * * * *